US005083370A

United States Patent [19]

Koch et al.

[11] Patent Number: 5,083,370

[45] Date of Patent: Jan. 28, 1992

[54] METHOD FOR AUTOMATICALLY CONNECTING ELECTRICAL CONDUCTORS TO CONTACT PARTS IN PLUG HOUSINGS

[75] Inventors: Max Koch, Meggen; Alois Lustenberger, Lucerne, both of Switzerland

[73] Assignee: Komax AG, Dierikon, Switzerland

[21] Appl. No.: 374,271

[22] Filed: Jun. 30, 1989

[30] Foreign Application Priority Data

Jul. 1, 1988 [CH] Switzerland ..... 02524/88

[51] Int. Cl.[5] ..... H01R 43/04

[52] U.S. Cl. ..... 29/863; 29/753; 414/736; 901/6; 901/30

[58] Field of Search ..... 29/753, 863, 747, 881; 414/736; 901/6, 30

[56] References Cited

U.S. PATENT DOCUMENTS

| | | | |
|---|---|---|---|
| 3,964,147 | 6/1976 | Fusco et al. . | |
| 4,074,424 | 2/1978 | Deshich et al. | 29/753 |
| 4,087,908 | 5/1978 | Fusco et al. | 29/753 |
| 4,164,065 | 8/1979 | Funcik et al. | 29/753 X |
| 4,375,229 | 3/1983 | Mikami et al. | 29/753 X |
| 4,426,772 | 1/1984 | Collier et al. | 29/747 X |
| 4,521,946 | 1/1985 | Dusel et al. | 29/33 M |
| 4,557,045 | 12/1985 | Serrano | 29/747 |
| 4,653,187 | 3/1987 | Sowinski | 29/884 |
| 4,658,503 | 4/1987 | Eaton . | |

FOREIGN PATENT DOCUMENTS

| | | |
|---|---|---|
| 50422 | 4/1982 | European Pat. Off. . |
| 2003759 | 3/1979 | United Kingdom . |

*Primary Examiner*—Carl J. Arbes
*Attorney, Agent, or Firm*—Horst M. Kasper

[57] ABSTRACT

The invention method and device for the automatic mounting of connector shells (5) and electric conductors (8) discloses that connector shells (5) are put on with the aid of an industrial robot (1) onto the contact parts (8.1, 8.2) of an electric conductor (8). A gripper tool (4) of the industrial robot (1) is capable to grip simultaneously several connector shells (5). Each contact part (8.1, 8.2) of the electric conductor (8) is maintained in rest position by two independently controllable gripper pairs (11.1, 11.2) of a double gripper (11) at the end of a cable-processing line (9), after a centering module (19) has set the desired position of the contact parts (8.1, 8.2). Depending on the intended device, the two contact parts (8.1, 8.2) of the electric conductor (8) can be simultaneously equipped with connector shells (5) by respectively one industrial robot (1), or successively by only one single industrial robot (1), with the aid of a transfer module (10), coordinated to the double gripper (11) and rotating the rotatable electric conductor (8). The error-free put-on of the connector shells, as well as a withdrawal motion required for the testing of the perfect contact seat, are surveyed by sensors. The finished, plugged-together cable harnesses (13) are for example transferred by two industrial robots (1), in a stretched state, individually, to a transport device (14) adapted to the length of the cable harness (13).

9 Claims, 3 Drawing Sheets

METHOD FOR AUTOMATICALLY CONNECTING ELECTRICAL CONDUCTORS TO CONTACT PARTS IN PLUG HOUSINGS

BACKGROUND OF THE INVENTION

1. Field of the Invention

The invention relates to a method for the automatic mounting of electric conductors with contact parts in connector shells with a gripper system and a device for performing the method.

2. Brief Description of the Background of the Invention Including Prior Art

A device for the mounting of electric conductors with contact parts in connector shells has been taught, for example, in the German Patent Application Laid Open DE-OS 2,740,377. This device, where a crimp device is combined with a plug device, is a so-called rigidly chained system. The gripper is moved by two piston cylinder units acting perpendicular relative to each other. The tensioning station is actuated by a further piston cylinder unit for a connector shell. The connector shell itself and further actuating and support means are in an interdependent, rigid relation, which is dependent on the construction and on the predetermined motion path of the device. A flexible mounting of desired contact parts with conductors in arbitrary connector shells is not possible with the taught reference device.

SUMMARY OF THE INVENTION

Purposes of the Invention

It is an object of the invention to provide a method for the mounting of electric conductors with contact parts in connector shells.

It is another object of the present invention to provide a device for mounting of electric conductors with contact parts in connector shells.

It is yet a further object of the invention to provide a system where identical or differing connector shells with electric conductors can be equipped or furnished with identical or differing contact parts fully automatically with an industrial robot.

These and other objects and advantages of the present invention will become evident from the description which follows.

BRIEF DESCRIPTION OF THE INVENTION

The present invention provides for a method for an automatic mounting of electric conductors, having contact parts, to connector shells. The method comprises the following process steps: At least one connector shell from a connector-shell magazine is gripped with a gripper tool supported by a gripper. Two contact parts of an electric conductor are centered at an end of a cable-processing line. The two contact parts are maintained in a rest position at the insulated conductor by respectively two gripper pairs of a double gripper. At least one robot gripper is moved in the direction of a contact part of the electric conductor. A connector shell having a recess is shifted, with the recess of the connector shell to align at a contact part of the electric conductor. A gripping front gripper pair of the double gripper opens at the contact part of the electric conductor. The connector shell is shifted with the gripper fully onto the contact part of the electric conductor for inserting the contact part into a recess of the connector shell. A rear gripper pair of the double gripper opens. A strip-off motion is carried out below a fixed separating element by the robot gripper with the inserted electric conductor for obtaining a finished equipped cable harness.

An insertion process of a connector shell at the contact part of the electric conductor is repeated upon a surpassing of a preset insertion force after a return motion of the robot gripper. An electric conductor is eliminated after a futile repeating of the insertion process.

The gripper is moved in a reverse direction relative to the insertion direction for testing the process result of the assembly of the connector shell onto the contact part of the electric conductor.

The double gripper is rotated by half a rotation around its longitudinal axis for plugging together the second contact part of the electric conductor with a respective connector shell.

A finished equipped cable harness is bound and the cable harness is electrically tested.

The present invention provides for an apparatus for an automatic mounting of electric conductors, having contact parts, into connector shells. A cable processing line is furnished for contact parts of electric conductors. A centering device is disposed at the end of the cable-processing line. A double gripper is attached to a rotatable transfer module for gripping one of the two contact parts of one electric conductor at the contact part and at an insulated section of the conductor. At least one fixedly disposed separating element for the electric conductor is inserted into a connector shell. At least one robot gripper of an industrial robot is disposed outside of the cable-processing line, is shiftable in all directions, and carries one gripper tool. The robot gripper tool grips at least one connector shell.

Gripper pairs, including two front gripper pairs and two rear gripper pairs of the double gripper, can be movable and controllable independent of each other.

A sensor can be disposed at the robot gripper for initiating a repetition of the insertion process of a contact part of the electric conductor into the connector shell upon measuring a surpassing of a preset insertion force. The sensor can survey, after termination of an assembly process, a withdrawal force of the motion, this motion being directed opposite relative to the insertion direction.

The gripper can extend the finished equipped cable harness. A transport device can receive the cable harness in an extended state. A binding device can be disposed between the industrial robot and the transport device. An electric testing device for cable harnesses can be disposed between the industrial robot and the transport device.

The advantages achieved by the invention include that a single work cycle suffices for the feeding of several identical or differing connector shells, for example, for the production of a cable harness with, in each case, three different connector shells on the two sides. In addition, it is more advantageous for the joining and assembly process if the connector shells are mounted at the contact parts of the electric conductor, maintained in a rest position at the end of a processing line. It is possible without clock cycle time loss to bring subsequently each newly mounted electric conductor only by a corresponding motion of the connector shells into a desired position relative to a fixed separating device, in order to free the path for the mounting of the connector shells to the contact parts of further electric conductors. A further advantage is also provided by the possibility to survey and to test each individual cable strand, on the one hand, during the mounting, and on the other hand, during the withdrawal test by the motion of the connector shells, again without clock cycle-time loss. A further advantage resides in the fact that program changes can be effected at any time and very quickly.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
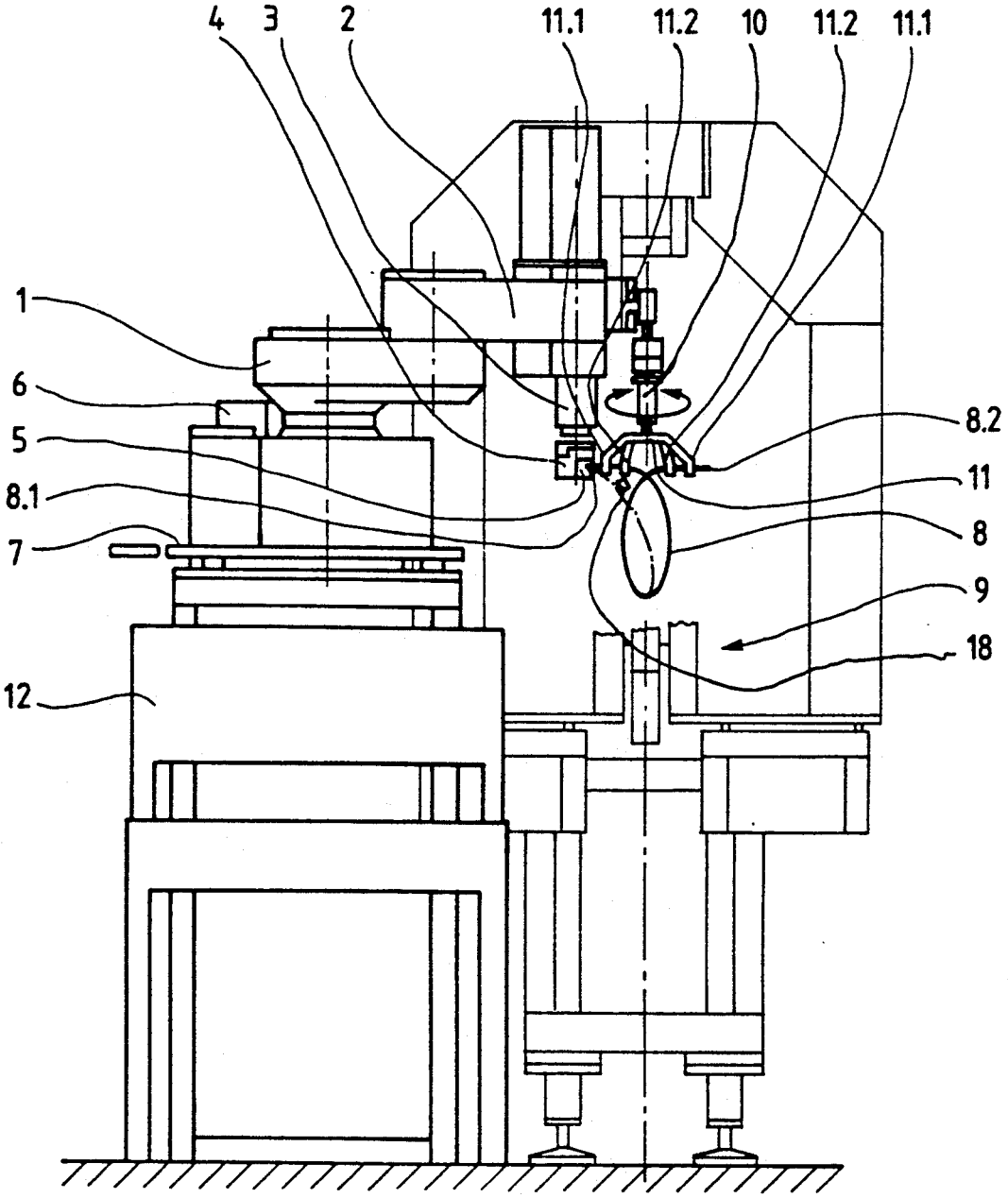
FIG. 1 is a schematic side-elevational view of a device for the automatic mounting of connector shells and electric conductors having contact parts using an industrial robot and a rotatable gripper module.

In accordance with the present invention, there is provided a method for the automatic mounting of electric conductors 8 with contact parts 8.1, 8.2 in connector shells 5 with a gripper system. The method includes the following process steps: At a gripper tool 4, supported by a robot gripper 3, grips at least one connector shell 5 from a connector-shell magazine 7.1, 7.2, 7.3. The two contact parts 8.1, 8.2 of the electric conductors 8 are centered at the end of a cable-processing line 9 and are maintained in a rest position at a contact part 8.1, 8.2 and at the insulated conductor 8 by respectively two gripper pairs 11.1, 11.2 of a double gripper 11. At least one robot gripper 3 moves in the direction of a contact part 8.1, 8.2 of the electric conductor 8 and shifts a connector shell 5 with one of its recesses to align at a contact part 8.1, 8.2 of the electric conductor 8. A outer gripper pair 11.1 of the double gripper 11 gripping at the contact part 8.1, 8.2 of the electric conductor 8, opens itself. The robot gripper 3 shifts the connector shell 5 fully onto the contact part 8.1, 8.2 of the electric conductor 8. A inner gripper pair 11.2 of the double gripper 11 opens. The robot gripper 3 carries out with the inserted electric conductor or conductors a strip-off motion below a fixed separating element 18.

The slide-on process of a connector shell 5 at the contact part 8.1, 8.2 of the electric conductor 8 can be repeated upon a surpassing of a preset put-on force after a return motion of the robot gripper 3. The electric conductor 8 can be eliminated after a futile repeating of the slide-on process. The robot gripper 3 can perform a motion opposite to the shift-in direction for testing the assembly process of the connector shell 5 on the contact part 8.1, 8.2 of the electric conductor 8. The double gripper 11 can be rotated by half a rotation around its longitudinal axis for plugging together the second contact part 8.2 of the electric conductor 8 with connector shells 5. The finished equipped cable harness 13 can be bound off. The cable harness 13 can be electrically tested.

The present invention provides furthermore for an apparatus for the automatic mounting of electric conductors 8 with contact parts 8.1, 8.2 in connector shells 5 by a gripper system. A centering device is disposed at the end of a cable-processing line 9 for the contact parts 8.1, 8.2 of the electric conductors 8. A double gripper 11 of a rotatable transfer module 10 grips one of the two contact parts 8.1, 8.2 of the electric conductor 8, respectively at the contact part and at the insulated conductor. There is furnished at least one fixedly disposed separating element 18 for the put-in electric conductor 8 and outside of the cable-processing station 9 at least one robot gripper 3, disposed shiftable in all directions, of an industrial robot 1 and carrying one gripper tool 4. The gripper tool 4 grips at least one connector shell 5.

All gripper pairs 11.1, 11.2, the two outer gripper pairs 11.1 as well as the two inner gripper pairs 11.2, of the double gripper 11 can be movable and controllable independent of each other. The repetition of the shift-in process of a connector shell 5 onto the contact part 8.1, 8.2 of the electric conductor 8 can be initiated by a sensor disposed at the robot gripper 3 upon surpassing of a preset insertion force. A sensor can be disposed at the gripper 3, which sensor can survey after termination of the assembly process the withdrawal force of the motion opposite to the insertion direction. A robot gripper 3 can extend the finished equipped cable harness 13. A transport device 14 can be provided for receiving the cable harness 13 in an extended state. A binding device 17 can be disposed between the industrial robot 1 and the transport device 14. An electric testing device for the cable harnesses 13 can be disposed between the industrial robot 1 and the transport device 14.

Figure 2:
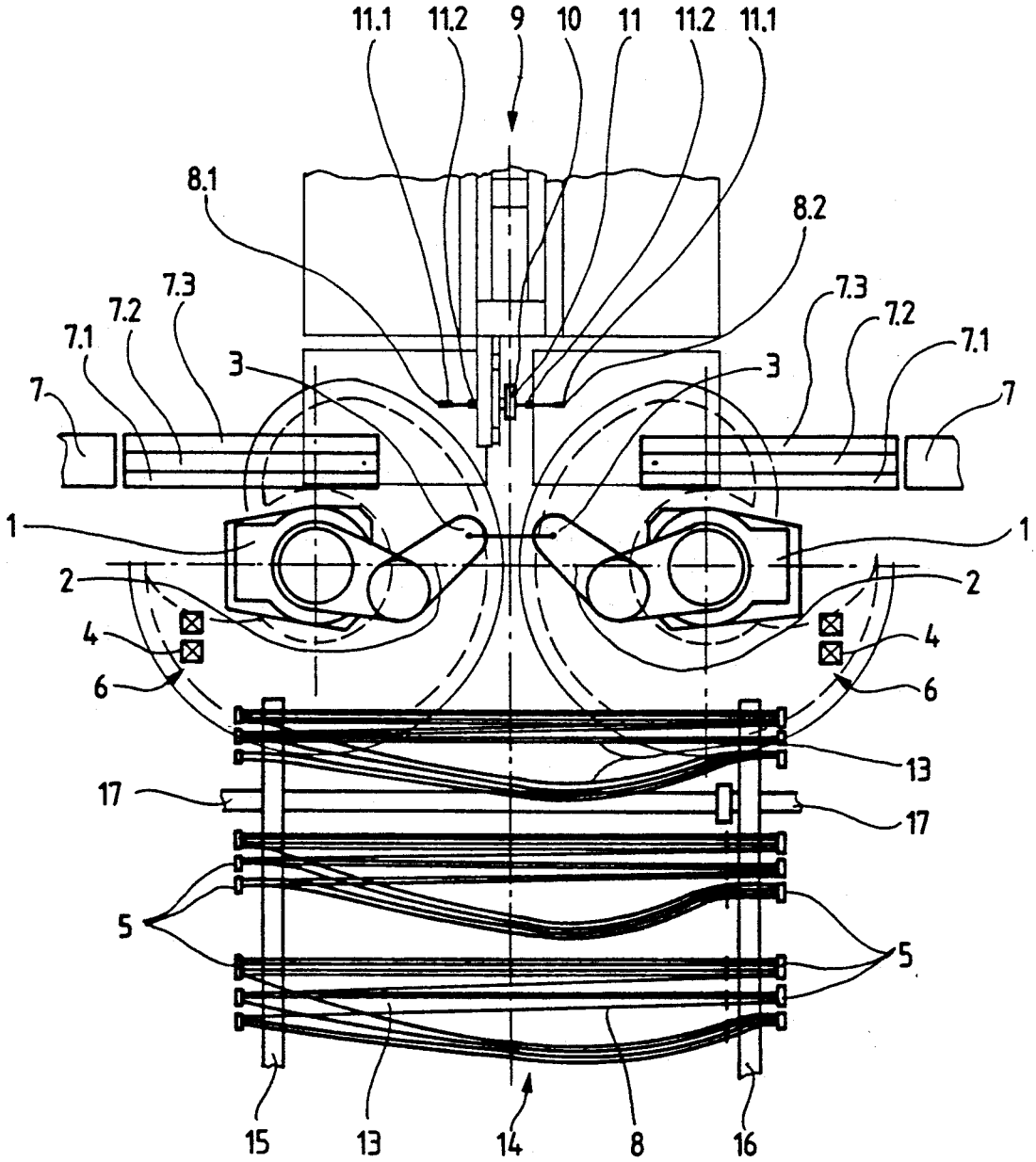
FIG. 2 is a schematic horizontal projection and view of a device for the automatic mounting of connector shells and electric conductors having contact parts with two industrial robots and a transport device for the transporting off of the finished cable harnesses in a partially extended state.

An industrial robot is designated with the reference numeral 1 in FIGS. 1 and 2. The industrial robot 1 exhibits a gripper arm 2 and a gripper 3. Different gripper tools 4 for a connector shell 5 or for several equal or different connector shells 5 are grippable with the gripper 3. The gripper tools 4 are disposed in a tool magazine 6 in the region of the gripper arm 2. Similarly, the connector shells 5, which are stored and ready supported in parallel adjacent connector-shell magazines 7, 7.1, 7.2, 7.3, are automatically replaced at each withdrawal. Simultaneously, several connector shells 5 can be received by the robot gripper 3 of the industrial robot 1 with the aid of the gripper tool 4. The contact parts 8.1, 8.2 of an electric conductor 8 are prepared in a processing line 9, not belonging to the subject-matter of the invention. The contact parts 8.1, 8.2 of the electric conductor 8 are moved forward in clock cycles by individual transfer modules 10. The two contact parts 8.1, 8.2 of the electric conductor 8 are received by a double gripper 11 at the end of a processing line 9 and are maintained in a rest position for further processing. The double gripper 11 comprises two outer gripper pairs 11.1 and two inner gripper pairs 11.2. All gripper pairs 11.1, 11.2 are movable and controllable independent of each other. The outer gripper pair 11.1 grips a prepared contact part 8.1, 8.2 of the electric conductor 8 such that the corresponding recess of the connector shell 5 and a contact part 8.1, 8.2 of the electric conductor 8 can be assembled and joined. In case of crimping contacts, the outer gripper pair 11.1 thus grips in the rear region of the insulation crimp, while the inner gripper pair 11.2 grips further in the rear, in the region of the insulation of the electric conductor 8. A fixed separating element 18 is disposed below the double gripper 11, which strips, by a motion of the robot gripper 3, the mounted electric conductors 8.

Following to the device for the automatic mounting of the connector shells 5 and of the electric conductors 8 with the contact parts 8.1, 8.2, there can be disposed a discharge device 12 for the receiving of the assembled and joined cable harnesses 13, as illustrated in FIG. 1, or a transport device 14, as illustrated in FIG. 2. The transport device 14 can comprise respectively two endless rubber-band pairs 15, 16, which can be moved apart and which, in each case, are disposed parallel and on top of each other. The rubber bands, disposed on top of each other, are driven with a different direction of rotation. The cable harnesses 13 are, preferably in a stretched state, clamped and carried along between the two center rubber belt strands running in the same direction. At least one binding device 17 for the binding of the finished cable harnesses can be placed at the beginning of the transport device.

The above-described device operates as follows: The contact parts 8.1, 8.2 of electric conductors 8 for the production of cable harnesses 13 are prepared on the processing line 9 of an independent cable-processing station. The contact parts 8.1, 8.2 of the electric conductors are brought into a desired position by a conventional centering module 19, such as for example taught in European Patent EP-A-0,041,332, at the end of the processing line 9, and the contact parts 8.1, 8.2 are received by the rotary transfer module 10 with the double grippers 11 for the production of cable harnesses 13. The prepared contact part 8.1, 8.2 is thereby maintained in a rest position, in each case, by an outer gripper pair 11.1 of the double gripper 11 in the region of the insulation crimp and, in each case, by an inner gripper pair 11.2 somewhat further inside, in the region of the insulation of the electric conductor 8. The device placed outside of the cable processing station for the automatic mounting of the electric conductors 8 and of the connector shells 5 is prepared in the meantime for the equipping of the connector shells 5. The robot gripper 3 of the industrial robot 1 can grip the corresponding gripping tool 4 for the receiving of the desired connector shell 5 for the intended cable-harness production from the tool magazine 6, or, since the gripper tool has to be exchanged only upon full program changes and thus relatively rarely, the gripper tool 4 is positioned manually at the robot gripper 3. The gripper arm 2 of the industrial robot 1 pivots to the side of the parallel disposed connector-shell magazine 7.1, 7.2, 7.3, and the gripper tool 4 grips the predetermined number of connector shells 5. The connector shells 5, removed from the connector-shell magazines 7.1, 7.2, 7.3, are replaced by connector shells 5 automatically pushed in from behind. The gripper arm 2 is shifted with the gripped connector shells 5 in front of the first contact part 8.1 of the electric conductor 8, supported by the double gripper 11. The axis of the predetermined recess of the connector shell 5 is aligned with the axis of the supported contact part 8.1 of the electric conductor 8. The robot gripper 3 now shifts itself with the gripper tool 4 and the connector shells 5 in the axial direction toward the contact part 8.1 of the electric conductor 8, until the contact part 8.1 of the electric conductor engages in the recess of the connector shell 5. The one outer gripper pair 11.1 of the double gripper 11 opens up and frees the path in order for the connector shell 5 to be fully slid onto the contact part 8.1. A withdrawal motion in the opposite direction with a pulling force, set and surveyed by a sensor, tests the safe seating of the contact part whereupon the inner gripper pair 11.2 of the double gripper 11 releases the contact part 8.1. The other contact part 8.2 of the electric conductor 8 can simultaneously be equipped, with the aid of a second industrial robot 1, with a connector shell 5, or the electric conductor 8 is rotated by 180 degrees in a horizontal plane with the aid of the rotation module 10 following to the equipping of the first contact part 8.1, whereby the second contact part 8.2, for example, is equipped with a second connector shell 5 of the same industrial robot 1. While the second contact part 8.2 of the electric conductor 8 is rotated toward the connector shell or a further new electric conductor 8 is fed in, the gripper moves with the connector shells such that the electric conductor 8 of the just mounted contact part, possibly together with all remaining already mounted electric conductors 8, is deflected by the fixedly disposed separating element 18, in order to provide the necessary free space for the mounting and assembly of further contact parts 8.1, 8.2 of electric conductors 8.

Figure 3:
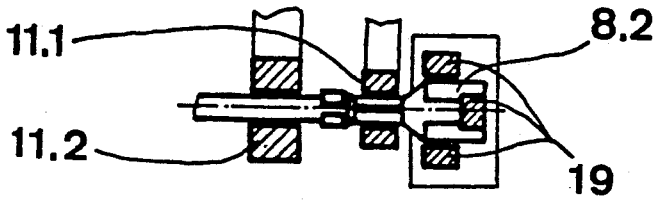
FIG. 3 is a sectional view of a gripper pairs and centering module with a first phase of gripping a contact part.

The contact part 8.2 of a completely fabricated electric conductor 8 is shown in FIG. 3 in a first phase. The contact part 8.2 is gripped by the gripper pairs 11.1 and 11.2 of the double gripper 11. The centering module 19 serves for a precise alignment of the contact part 8.2 of the electric conductor 8 of the crimp contact. The centering module 19 can be of conventional construction such as is taught, for example, in the European Patent Document EP-A-0,041,332, where a terminal positioner 75 with arms 78 and recesses 79 is illustrated in FIGS. 7, 8, and 10 of this reference.

Figure 4:
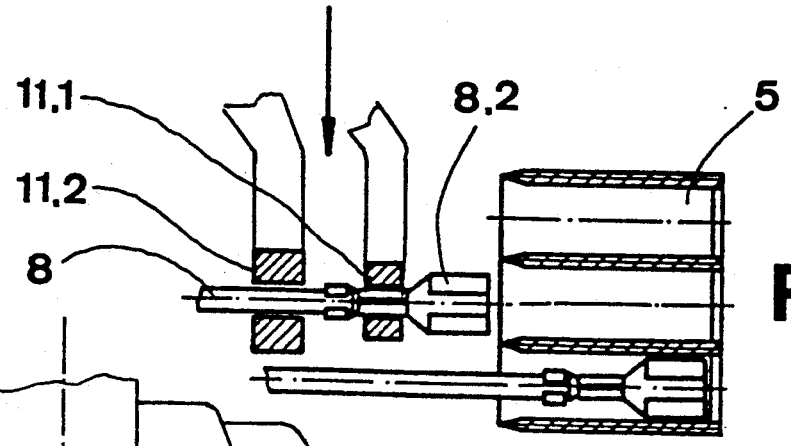
FIG. 4 is a view of the embodiment of FIG. 3 in a second phase.

In a second phase, as shown in FIG. 4, where the centering module 19 is tilted away, a connector shell 5 is fed in and is furnished with a first, already mounted electric conductor 8.

Figure 5:
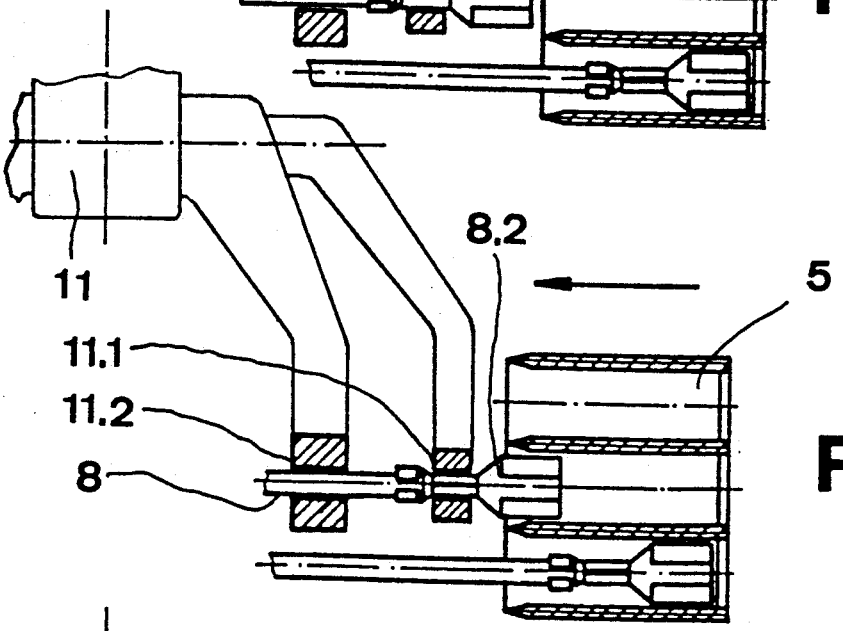
FIG. 5 is a view of the embodiment of FIG. 3 in a third phase.

In a third phase, as shown in FIG. 5, the connector shell 5 is mounted to the crimping contact, where both gripper pairs 11.1 and 11.2 of the double gripper 11 are closed.

Figure 6:
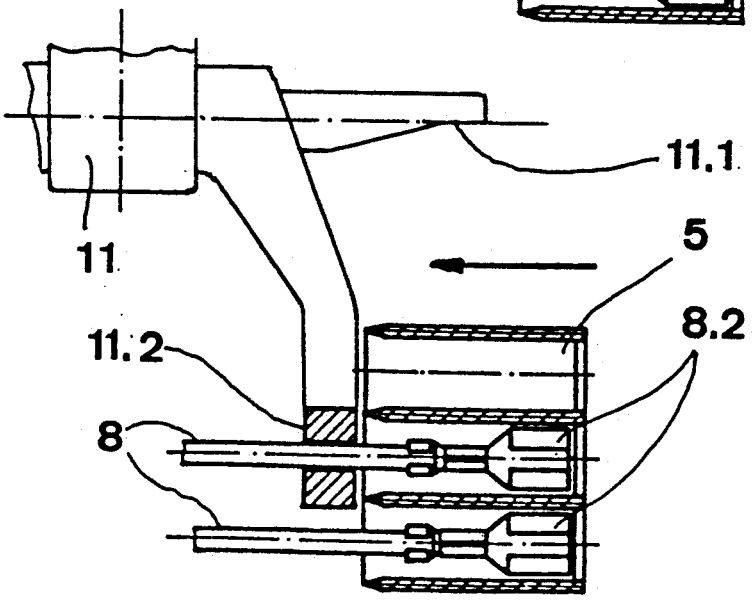
FIG. 6 is a view of the embodiment of FIG. 3 in a fourth phase.

In a fourth phase, as shown in FIG. 6, with the gripper pair 11.1 tilted away, the connector shell 5 is definitively mounted to the contact part 8.2 of the second electric conductor 8.

Further electric conductors 8 are cyclically received by the double grippers 11 of the rotatable transfer module 10 and are combined in the same, above-described way with connector shells until all desired recesses of the connector shells 5 are furnished with electric conductors 8 and a finished equipped cable harness 13 is formed. For this purpose, it is respectively additionally required to shift the robot gripper 3 with the connector shells from one recess of the connector shells 5 to a desired other recess, whereby the axis of the respective recess is aligned and coincides with the axis of the gripped contact part 8.1, 8.2 of the electric conductor 8.

The finished cable harness 13 can now, for example according to FIG. 1, be placed by a gripper arm 2 into a discharge bin 12, for example a tub, or, according to FIG. 2, be transferred to a transport device 14, where the finished equipped cable harness 13, in this case, is placed by the two industrial robots 1, with the aid of the gripped connector shells 5, with preferably extended electric conductors 8, between the two center belt strands of the rubber bands of the transport device 14. The two belt strands, running in the same direction, grip the cable harness 13 and transport it to a collection location. The horizontal distance between the two rubber-band pairs 15, 16, disposed above each other, can be set in advance, depending on the length of the electric conductors 8.

In addition, a binding device 17 can be controlled ahead of the transfer of the cable harness from the industrial robot 1 to the transport device 14. The binding device 17 can cleanly bind the stretched section of the cable harness 13 at desired locations. It is also possible, in order to release the industrial robot for other manipulations or shorter clock cycle times at a higher frequency, to provide an additional device in front of the transport device, which receives the cable harness from the robot in order to perform further operations without clock cycle time losses for the robot, such as, for example, for an overall electric testing, for labelling of connector shells, or for the closing of protective covers belonging to the connector shells. The same additional device would then also be responsible for the subsequent transfer of the cable harnesses to the transport device.

It can occur that a centered contact 8.1, 8.2 of the electric conductor 8, properly gripped by the double gripper 11, exhibits deficiencies which prevent a proper mounting of a connector shell 5 to the contact part 8.1, 8.2, for example, when parts of a damaged contact part protrude and are exposed or unconnected at the body of the connector shell 5. Interferences of this kind are excluded by a surveillance of the mounting force by a sensor, not illustrated and disposed at the robot gripper 3. Upon surpassing of a predetermined force, and before a further damaging occurs, a return motion of the robot gripper 3 and a renewed mounting attempt is initiated. If also the second, or possibly, the third mounting attempt fails, the defective electric conductor 8 is rejected and eliminated. The same or an additional sensor is employed for the testing of the mounted and joined plug connection, by subjecting each individual connected conductor 8 to a likewise predetermined tension force. If the tension force is not reached during the pull-off test, this means a bad contact seat and the tested electric conductor 8, possibly with already connected additional connections, is also eliminated.

A cross transport band or only a collection bin could be disposed below the assembled device for the removal of possibly eliminated defective cable harness parts.

It will be understood that each of the elements described above, or two or more together, may also find a useful application in other types of system configurations and automatic-mounting procedures differing from the types described above.

While the invention has been illustrated and described as embodied in the context of a method for automatic mounting of electric conductors with contact parts in connector shells, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for an automatic mounting and discharging of electric conductors, having contact parts, to connector shells comprising the following process steps:

gripping one connector shell from a connector-shell magazine with a gripper tool supported by a robot gripper;

centering two contact parts of an electric conductor at an end of a cable-processing line;

maintaining the two contact parts in a rest position at the insulated conductor by respectively an outer gripper pair and an inner gripper pair of a double gripper;

moving the robot gripper in the direction of a contact part of the electric conductor;

shifting a connector shell having a recess, with the recess to align at a contact part of the electric conductor;

opening of the outer gripper pair of the double gripper by itself, where the outer gripper pair grips the contact part of the electric conductor;

shifting the connector shell with the robot gripper fully onto the contact part of the electric conductor for inserting the contact part into a recess of the connector shell;

opening the inner gripper pair of the double gripper; carrying out a separating motion below a fixed separating element by the robot gripper with the inserted electric conductor for obtaining a finished equipped cable harness.

2. The method according to claim 1, further comprising repeating an inserting step until a preset insertion force; returning the robot gripper to an initial position;

monitoring a surpassing of a preset insertion force;

inserting a connector shell into the contact part of the electric conductor.

3. The method according to claim 2, further comprising eliminating an electric conductor after a futile repeating of the insertion process.

4. The method according to claim 1, further comprising moving the robot gripper in a reverse direction relative to the insertion direction for testing the process result of the assembly of the connector shell onto the contact part of the electric conductor.

5. The method according to claim 1, further comprising rotating the double gripper by half a rotation around its longitudinal axis for plugging together the second contact part of the electric conductor with a respective connector shell.

6. The method according to claim 1, further comprising binding of a finished equipped cable harness.

7. The method according to claim 1, further comprising testing the cable harness electrically.

8. A method for an automatic making of electric conductors (8) with contact parts (8.1, 8.2) in connector shells (5) with a gripper system, including the following process steps:

at a gripper tool (4), supported by a robot gripper (3) grips one connector shell (5) from a connector-shell magazine (7.1, 7.2, 7.3), the two contact parts (8.1, 8.2) of the electric conductors (8) are centered at the end of a cable-processing line (9) and are maintained in a rest position at a contact part (8.1, 8.2) and at the insulated conductor (8) by respectively a outer gripper pair 11.1 and an inner gripper pair (11.2) of a double gripper (11), one robot gripper (3) moves in the direction of a contact part (8.1, 8.2) of the electric conductor (8) and shifts a connector shell (5) with one of its recesses to align at a contact part (8.1, 8.2) of the electric conductor (8), the outer gripper pair (11.1) of the double gripper (11), gripping at the contact part (8.1, 8.2) of the electric conductor (8), opens itself, the robot gripper (3) shifts the connector shell (5) fully onto the contact part (8.1, 8.2) of the electric conductor (8), an inner gripper pair (11.2) of the double gripper (11) opens, the robot gripper (3) carries out with the inserted electric conductor or conductors a strip-off motion with a fixed separating element (18).

9. The method according to claim 8, repeating the slide-on process of a connector shell (5) at the contact part (8.1, 8.2) of the electric conductor (8) is repeated upon a surpassing of a preset put-on force after a return motion of the robot gripper (3);

disconnecting the electric conductor (8) after a futile repeating of the slide-on process;

attempting the robot gripper (3) to perform a motion opposite to the shift-in direction for testing the assembly process of the connector shell (5) on the contact part (8.1, 8.2) of the electric conductor (8);

rotating the double gripper (11) by half a rotation around its longitudinal axis for plugging together the second contact part (8.2) of the electric conductor (8) with connector shells (5);

finishing off the equipped cable harness (13);

testing the cable harness (13) electrically.

* * * * *